US005247869A

United States Patent [19]

Palmberg et al.

[11] Patent Number: 5,247,869

[45] Date of Patent: Sep. 28, 1993

[54] METHOD AND A DEVICE FOR DAMPING FLOW PULSATIONS IN HYDROSTATIC HYDRAULIC MACHINES OF THE DISPLACEMENT TYPE

[75] Inventors: Jan-Ove Palmberg; Maria Pettersson, both of Linköping; Stig Bratt, Trollhättan, all of Sweden

[73] Assignee: VOAC Hydraulics i Trollhattan AB, Trollhattan, Sweden

[21] Appl. No.: 937,693

[22] Filed: Sep. 1, 1992

[30] Foreign Application Priority Data

Sep. 6, 1991 [SE] Sweden ..... 9102570

[51] Int. Cl.[5] ..... F04B 1/20

[52] U.S. Cl. ..... 91/487

[58] Field of Search ..... 91/6.5, 486, 487

[56] References Cited

U.S. PATENT DOCUMENTS 3,199,461 8/1965 Wolf ..... 91/6.5
3,362,342 1/1968 Flint et al. .
3,999,466 12/1976 Aschke ..... 91/499
4,096,786 6/1978 Schauer ..... 91/499
4,791,858 12/1988 Nonenmacher ..... 91/487 X

FOREIGN PATENT DOCUMENTS 2816060 11/1978 Fed. Rep. of Germany .

*Primary Examiner*—Richard E. Gluck
*Attorney, Agent, or Firm*—Pollock, Vande Sande and Priddy

[57] ABSTRACT

Each cylinder of a hydrostatic hydraulic machine of the displacement type is preliminarily pressurized after the inlet port of the cylinder has been exposed to the low pressure side of the machine and before the inlet port of the cylinder is exposed to the high pressure side of the machine. The preliminary pressurization is effected by use of a separate pressure chamber containing a pressurized fluid that is rapidly discharged into the inlet port of each cylinder before the cylinder inlet port is exposed to the high pressure side of the machine. The separate pressure chamber is recharged from the high pressure side of the machine at a rate that is slower than the rate at which pressurized fluid is discharged from the chamber into the inlet port of a cylinder.

8 Claims, 4 Drawing Sheets

METHOD AND A DEVICE FOR DAMPING FLOW PULSATIONS IN HYDROSTATIC HYDRAULIC MACHINES OF THE DISPLACEMENT TYPE

BACKGROUND OF THE INVENTION

The present invention relates to a method and apparatus for damping flow pulsations in hydrostatic hydraulic machines of the displacement type. The machines with which the invention is concerned are preferably axial piston machines that operate as variable displacement pumps and motors, and particularly such machines in which means are provided to effect a preliminary pressurization of each cylinder after the inlet port of the cylinder has been exposed to the low pressure side of the machine and before the inlet port of the cylinder is fully exposed to the high pressure side of the machine.

Hydrostatic hydraulic machines of the foregoing type are being used with increasing frequency. In the development of such machines an effort has been made to increase the working pressure in the machine, and also to reduce the weight of the machines by utilizing the materials thereof in more efficient ways. As a result of these conflicting requirements, machines of this type have exhibited disturbing noise and vibration problems. Efforts have been made to reduce the generation of noise and vibrations by focusing on both the internal power balance of the machine and flow pulsations generated by the machine. In this latter respect, for example, when the machine takes the form of a hydraulic pump of the displacement type, working fluid is transported from the high pressure side of the machine to the low pressure side of the machine through closed chambers in which flow pulsations occur. When the machines are of the piston type, there is a return flow into the cylinder when the cylinder passes from the low pressure side to the high pressure side of the machine, and since the working fluid is compressible and there may also be a deformation of the materials employed in the machine, the return flow also causes pulsations.

The pulsating flows which occur in machines of the types described above is periodic and occurs at a basic frequency that is equal to the pump speed multiplied by the number of pistons in the machine. It has been found in practice that hydraulic pumps of the types described above provide flow pulsations over a comparatively wide frequency spectrum ranging from a fundamental tone up to ten or more harmonics. To reduce the generation of noise and vibrations, therefore, it is extremely important to damp the flow pulsations. Efforts have been made to do so in the past, primarily by techniques which act upon the dynamic portion of the flow pulsations, i.e., the flow that is required to compress the oil in a cylinder of the machine when the cylinder is first exposed to the high pressure side of the machine.

More particularly, machines of the type with which the present invention are concerned typically employ a pressure control device taking the form of a valve disk having a pair of control ports, normally of kidney shape, that are connected respectively to the low pressure side and high pressure side of the machine. The inlet ports of the several cylinders in the machine are moved relative to the control ports of the valve disk so that the inlet port of each machine is alternately exposed to the low and high pressure sides of the machine. In an effort to reduce noise and vibration resulting from the compression of oil or working fluid in a cylinder when the cylinder first communicates with the high pressure control port of the valve disk, the valve disks have been provided with creep grooves, and/or one of the kidney-shaped control ports in the valve disk has been offset, so as to obtain a pre-compression of the oil or working fluid in a cylinder before the inlet port of that cylinder is fully exposed to the high pressure side of the machine. Moreover, attempts have also been made to damp flow pulsations in such machines by offsetting the kidney-shaped high pressure control port of the valve disk by a significant amount, and relying upon a check valve to connect the cylinder to the high pressure side of the machine at an appropriate moment.

Approximately equal improvements have been achieved in certain cases where pre-compression has been effected by offsetting the kidney-shaped high pressure control port of the valve disk or by providing a creep groove in the valve disk. In order to provide a mechanism that permits variation in the machine function, arrangements have been suggested wherein the valve disk is rotatable, or wherein a check valve is used to connect each cylinder to the high pressure port of the valve disk when the pressure is the same as that of the high pressure side of the machine. Experience has revealed that the results achieved with creep grooves are subject to greater variation than pre-compression that is effected by use of a rotatable valve disk, and the rotatable valve disk approach therefore is more effective functionally but more complicated structurally. Pre-compression achieved by use of a creep groove, however, can be optimized for relatively high power output machines. The functional advantages of the rotatable valve disk approach therefore are applicable primarily to lower power output machines in which the flow pulsations are much smaller. If a check valve is employed to connect the inlet port of the cylinder to the high pressure control port of the valve disk at an appropriate cylinder pressure, it is theoretically possible to achieve better results under all operating conditions; however while very good results have been achieved in simulation tests employing check valves, problems have arisen when the check valve approach has been attempted in operating machines due to the high rapidity with which the check valve must function to achieve satisfactory operation.

Examples of prior designs in which approaches of the above types have been suggested are disclosed in GB-A549323 (a machine of the yoke type having a valve mechanism in the valve disk), DE-B-2038086 (an axial piston machine of the swash-plate type having relief channels in the valve disk), U.S. Pat. No. 3,362,342 (an axial piston machine of the swash-plate type having a pressure relief channel between the high pressure side and the low pressure side), GB-A-1143681 (an axial piston machine of the swash plate type having a cylinder drum which employs ports of a special design, and creep grooves in a valve disk), DE-A-1528367 (an axial piston machine of the swash-plate type having pressure relief channels externally of the valve disk, and also provided with valves), DE-B-1211943 (valved pressure relief channels in the valve disk of an axial piston machine of the swash-plate type), and DE-B-1058370 (an axial piston machine of the swash-plate type having pressure relief channels in the valve disk).

SUMMARY OF THE INVENTION

The present invention provides a method and apparatus which achieves more effective damping of flow pulsations in hydrostatic hydraulic machines of the displacement type, and which is particularly effective in damping the lower overtones of such pulsations. The improvement is achieved by effecting a preliminary pressurization or pre-compression of the working fluid in each cylinder of a multiple cylinder hydraulic machine, wherein (a) the machine is provided with a pressure chamber of predetermined volume, separate from the high pressure and low pressure sides of the machine, containing high pressure fluid, (b) the pressurized fluid in the separate pressure chamber is rapidly discharged into the inlet port of each cylinder after the inlet port of the cylinder has been exposed to the low pressure side of the machine and before that inlet port is exposed to the high pressure side of the machine, and (c) pressurized fluid is charged into the separate pressure chamber at a rate that is slower than the rate at which pressurized fluid is discharged from the pressurized chamber into the inlet port of the cylinder.

In a particular embodiment of the invention, the valve disk of the machine is provided with an auxiliary port that is located between the kidney-shaped high pressure and low pressure control ports of the disk, a first duct is provided to connect the aforementioned separate pressure chamber to that auxiliary port, a further duct is provided which connects the separate pressure chamber to the high pressure side of the machine, and the duct used to connect the separate pressure chamber to the high pressure side of the machine has a smaller effective cross-sectional area than the duct which connects the separate pressure chamber to the auxiliary port in the valve disk. The inlet port of each cylinder in the machine is shaped to define a first portion which communicates with the kidney-shaped control ports of the valve disk, and shaped to define at least one further portion that communicates with the auxiliary port in the valve disk, during the relative motion between the cylinder inlet ports and the ports of the valve disk. Due to the shape of each cylinder inlet port, the locations of the control ports and auxiliary port in the valve disk, and the difference in effective cross sections of the ducts used to connect the separate pressure chamber to the high pressure side of the machine and to the auxiliary port in the valve disk, the pressurized fluid in the separate pressure chamber is rapidly discharged into the inlet port of a given cylinder after the inlet port has been exposed to the low pressure side of the machine and before the inlet port of the cylinder is exposed to the high pressure side of the machine, and pressurized fluid is charged back into the pressure chamber, either simultaneous with the discharge of pressurized fluid therefrom or subsequent to the discharge of pressurized fluid from the separate pressure chamber, at a rate that is slower than the rate at which pressurized fluid is discharged from the chamber.

BRIEF DESCRIPTION OF THE DRAWINGS

The foregoing construction and operation of the present invention will become more readily apparent from the following description and accompanying drawings in which.

DESCRIPTION OF THE PREFERRED EMBODIMENTS

Figure 4:
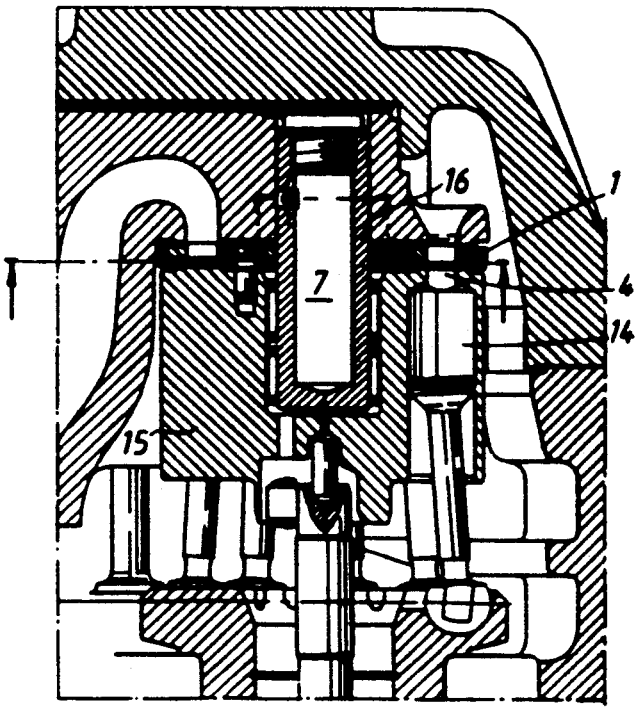
FIG. 4 is a longitudinal section through an axial piston machine employing the present invention, illustrating a possible location of the separate pre-compression chamber within the bearing shaft of the cylinder drum.

The principle of the present invention will initially be described by reference to FIG. 1. A valve disk 1, of the type conventionally employed in an axial piston machine, is provided with a pair of diametrically opposed approximately kidney-shaped valve openings 2, 3 that are connected respectively to the low pressure side and high pressure side of a hydraulic circuit in the machine. The axial piston machine is not further illustrated in FIG. 1, but valve disk 1 may be employed, as shown in FIG. 4, in a machine that operates as a pump and has a plurality of circumferentially distributed cylinders 14 located in a rotatable cylinder drum 15 associated with a central bearing shaft 16. The end of cylinder drum 15 that faces the valve disk 1 is provided with a plurality of cylinder inlet ports 4, one for each cylinder, each of which also has a generally kidney shape.

Figure 1:
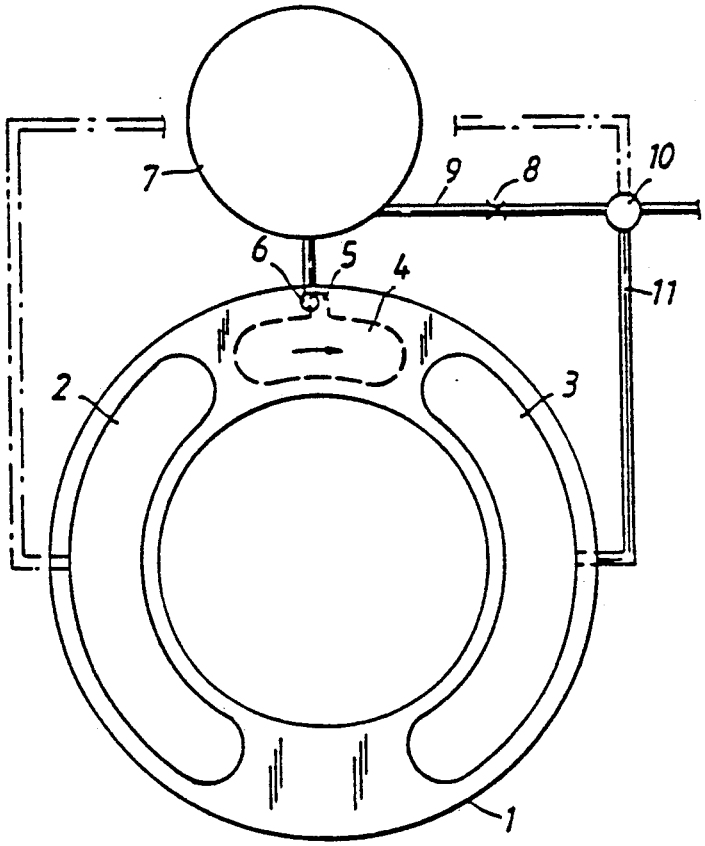
FIG. 1 is a diagrammatic plan view of a valve disk of an axial piston machine constructed in accordance with the present invention and connected to a separate pre-compression chamber in accordance with the present invention, FIGS. *2a–2f* illustrate the successive positions of rotating cylinder inlet ports in a cylinder drum of an axial piston machine wherein the cylinder inlet ports are shaped differently from the inlet port depicted in FIG. 1, FIGS. *3a* and *3b* are graphical representations that diagrammatically compare the flow pulsation damping action achieved by the present invention with the damping action achieved by use of a valve disk having creep grooves, and with the undamped pulsations that occur when the machine simply employs a conventional motor disk without pre-compression.
Figure 2A:
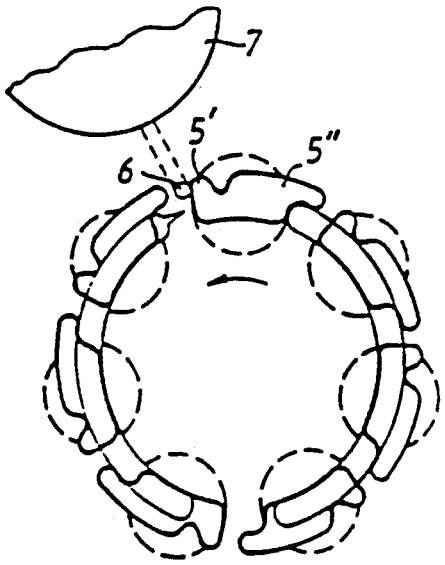
Figure 2B:
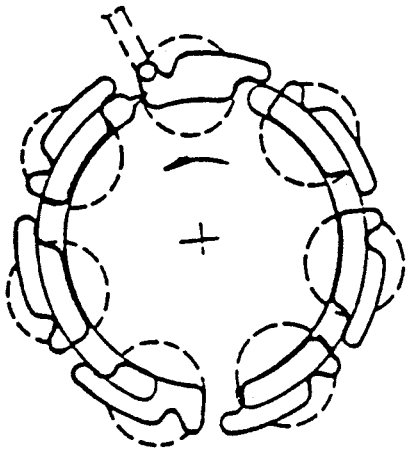
Figure 2C:
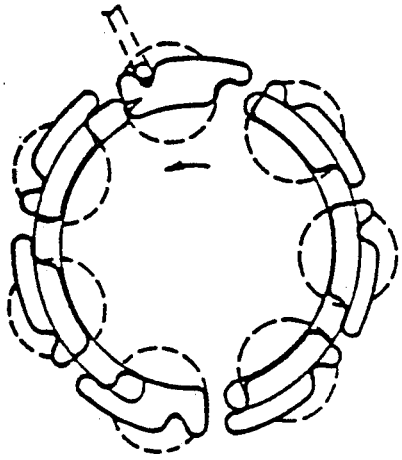
Figure 2D:
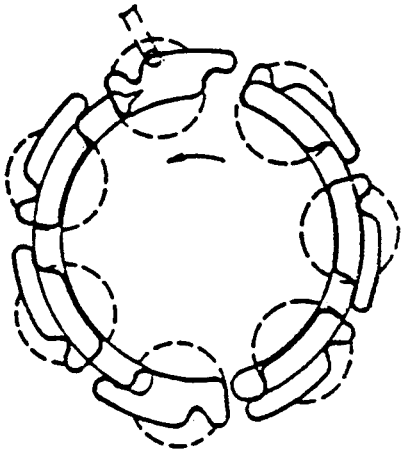
Figure 2E:
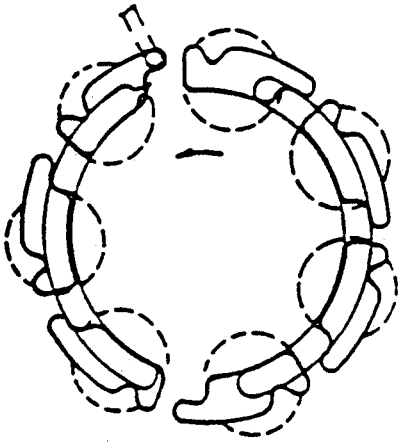
Figure 2F:
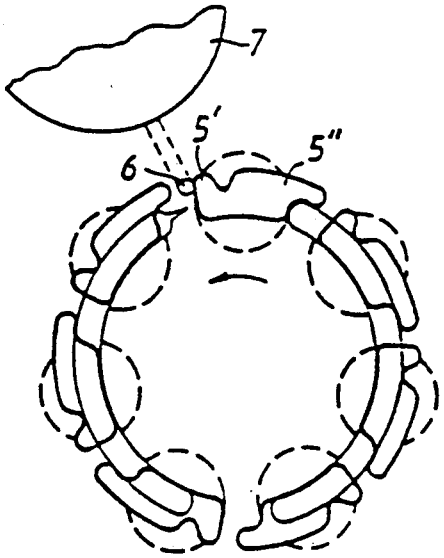

One of the cylinder inlet ports 4 is shown in broken line in FIG. 1. The position of the port 4 is illustrated at the moment when that port faces the portion of valve disk 1, situated between the valve disk control ports 2 and 3, after the cylinder inlet port 4 has passed low pressure control port 2 in the valve disk and before it has reached high pressure control port 3 in the disk during the relative rotation between valve disk 1 and cylinder drum 15. In accordance with the present invention, the shape of the cylinder inlet port 4 is modified, from the shape conventionally employed in the past, so as to exhibit a radially outwardly directed notch 5 in the radially outward longer side of port 4, having a substantially U shape. In addition, the valve disk 1 is provided with an auxiliary port 6 located substantially midway between control ports 2 and 3, port 6 being so positioned and dimensioned in relation to the position and size of notch 5 that, during the relative rotation between valve disk 1 and the cylinder inlet ports 4, the notch 5 of each cylinder inlet port 4 communicates with auxiliary port 6 after the main portion of port 4 has passed low pressure port 2 of disk 1 and before it communicates with high pressure port 3 in the valve disk.

Auxiliary port 6 is connected to a separate pressure chamber 7 that is suitably located in the machine, e.g., in a dead space of the machine or, as illustrated in FIG. 4, within the central bearing shaft 16 of the cylinder drum 15. Chamber 7 is connected to the high pressure side of the hydraulic system in the machine through conduits 9 and 11 and, possibly, a shift valve 10. Conduit 9 includes a restriction 8 which reduces the effective cross-sectional area of conduit 9 below the effective cross-sectional area of a further conduit that connects chamber 7 to auxiliary port 6 in valve disk 1.

With the arrangement shown in FIG. 1, after each cylinder inlet port 4 has left low pressure or port 2 in valve disk 1 and moves toward high pressure port 3 in the disk, the notch 5 portion of the cylinder inlet port will communicate with auxiliary port 6 to connect inlet port 4 to the high pressure fluid in pressure chamber 7 before inlet port 4 reaches high pressure valve port 3 in the disk. As a result the fluid in the cylinder associated with that inlet port 4 will be pre-compressed, and pressure equalization will be effected, before the cylinder inlet port 4 is exposed to the high pressure side of the machine. Due to the difference in effective cross sectional areas of the ducts connecting pressure chamber 7 to auxiliary port 6, and connecting chamber 7 to the high pressure side of the machine, the pre-compression fluid in chamber 7 will be rapidly discharged into the associated cylinder but more slowly recharged from the high pressure side of the machine through restriction 8. This difference in charging and discharging rates provides a buffering action or an equalization in the development of flow pulsations. In effect, the separate chamber 7 acts as a pulsation "filter".

FIGS. 2*a*–2*f* illustrate successive rotor positions of an alternative embodiment of the invention wherein, unlike the FIG. 1 embodiment, the pre-compression chamber 7 is not connected directly to the high pressure side of the machine through conduits 9 and 11, but is instead adapted to be both discharged and recharged through the channel connecting chamber 7 to auxiliary port 6 in the valve disk. Port 6 is asymmetrically located in the valve disk. In addition, each cylinder inlet port is shaped differently from the port 4 shown in FIG. 1, i.e., in the embodiment of FIG. 2 each cylinder inlet port is provided with a recess in the radially outward wall of the port instead of the outwardly projecting notch of the FIG. 1 embodiment. The recess in the FIG. 2 embodiment of the invention divides the outer wall of each cylinder inlet port into a leading U-shaped portion 5′, as seen in the direction of rotation of the cylinder drum, and a trailing elongated portion 5″ that, as illustrated, can extend beyond the trailing edge of the cylinder inlet port.

In the arrangement shown in FIG. 2, rotation of the cylinder drum will first cause portion 5′ of each cylinder inlet port to approach (FIG. 2*a*) and then communicate (FIG. 2*b*) with auxiliary port 6 so that the highly pressurized fluid in separate pressure chamber 7 is rapidly discharged into the associated cylinder. After this introductory equalization, as the drum continues its rotation the recess in the wall of the cylinder inlet port interrupts communication between auxiliary port 6 and chamber may be connected to the high pressure port 3 of the valve disk via a creep groove. Thereafter, as drum rotation continues, the cylinder inlet port communicates with the high pressure port 3 in the valve disk, and also communicates with separate pressure chamber 7 due to the overlap of portion 5″ and auxiliary port 6, to again charge separate chamber 7 to a high pressure (FIG. 2*d*). This continues until the drum has rotated so far that the auxiliary port 6 is located at the end of the portion 5″ which lies behind the cylinder inlet port (FIG. 2*e*). Immediately thereafter, as the drum continues to rotate, the auxiliary port 6 is again closed for a short moment before it again encounters the portion 5′ of the next subsequent cylinder inlet port to repeat the cycle (FIG. 2*f*, which corresponds to FIG. 2*a*).

The main idea behind the second embodiment of the invention shown in FIG. 2 is that the charging of chamber 7 to a high pressure, and the discharge of chamber 7 into a given cylinder inlet port, do not occur simultaneously. This is achieved simply by shaping the cylinder port in the manner illustrated in FIG. 2 without requiring any further components.

Figure 3A:
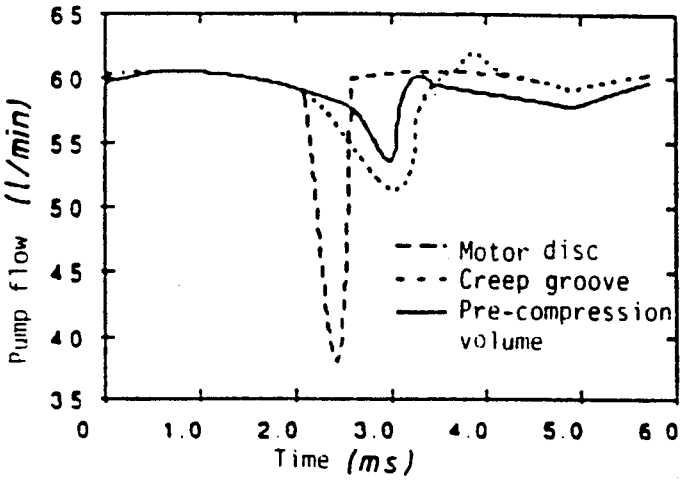
Figure 3B:
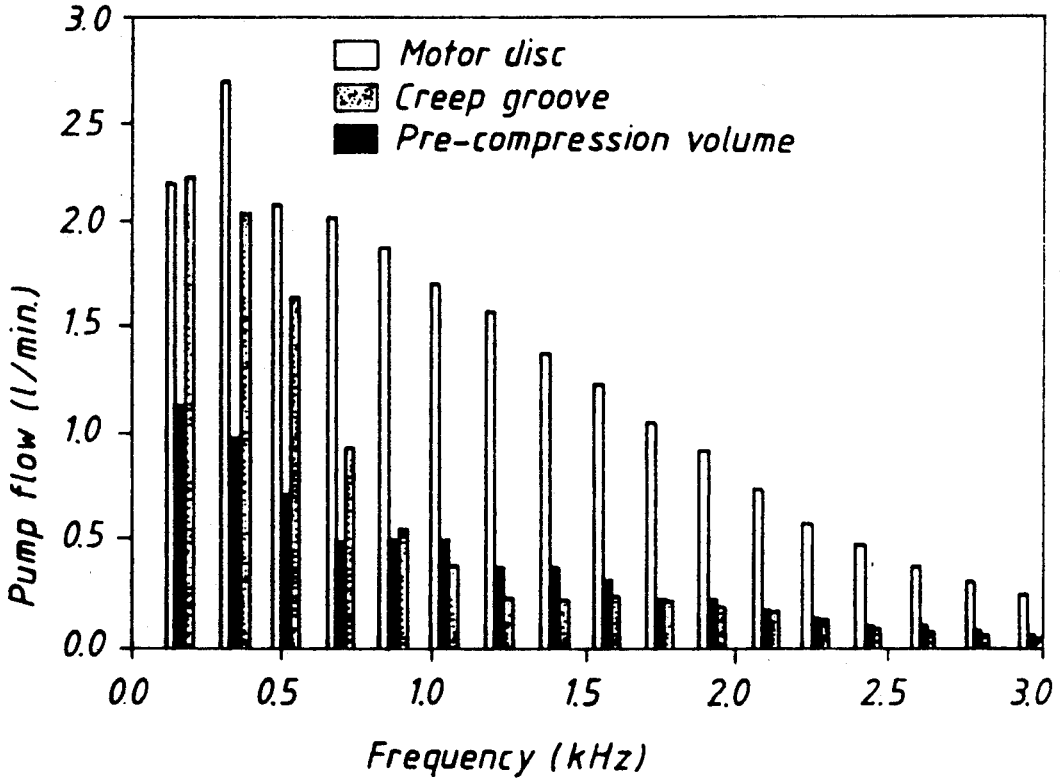

FIGS. 3*a* and 3*b* illustrate the advantages achieved by the present invention. FIG. 3*a* illustrates pump flow versus time in respect to a machine wherein flow pulsations are not damped at all (the "motor disk" curve), as compared with the results achieved when damping is effected by means of a prior art creep groove arrangement (the "creep groove" curve), and as further compared with the damping that is achieved by the arrangement of the present invention (the "pre-compression volume" curve). As clearly shown in FIG. 3*a*, the present invention causes flow pulsations to exhibit a smaller duration and smaller amplitude than are achieved by prior art pre-compression arrangements employing a creep groove. FIG. 3*b*, which plots pump flow versus frequency for the same three situations plotted in FIG. 3*a*, further illustrates that the present invention reduces both the fundamental tone of the pressure pulsation and also reduces the lower important harmonics or overtones.

Having thus described the invention we claim:

1. In a hydrostatic machine of the displacement type comprising a plurality of cylinders each of which has an inlet port, a pressure control device comprising a pair of spaced control ports that are connected respectively to a high pressure side and a low pressure side of said machine, means for effecting relative motion between said inlet ports of said cylinders and said control ports of said pressure control device to successively expose said cylinders to the low and high pressure sides of said machine, and means for effecting a preliminary pressurization of each cylinder before the inlet port of said cylinder is exposed to the high pressure side of said machine, the improvement wherein said preliminary pressurization means comprises a pressure chamber separate from the high pressure and low pressure sides of said machine, means for rapidly discharging a pressurized fluid from said pressure chamber into the inlet port of each cylinder after said inlet port of said cylinder has been exposed to the low pressure side of said machine and before said inlet port is exposed to the high pressure side of said machine, and means for charging pressurized fluid into said pressure chamber at a rate that is slower than the rate at which pressurized fluid is discharged from said pressure chamber into the inlet port of a cylinder, the difference in the charging and discharging rates of said pressurized fluid into and out of said pressure chamber being operative to reduce the generation of noise and vibration resulting from operation of the hydrostatic machine.

2. The machine of claim 1 wherein said charging of pressurized fluid into said pressure chamber occurs simultaneously with the discharge of pressurized fluid from said chamber into the inlet port of a cylinder.

3. The machine of claim 1 wherein said means for discharging pressurized fluid from said pressure chamber comprises an auxiliary port in said pressure control device, and a first duct connecting said pressure chamber to said auxiliary port, said means for charging pressurized fluid into said pressure chamber comprising a second duct connecting said pressure chamber to the high pressure side of said machine, the effective cross sectional area of said second duct being smaller than the effective cross sectional area of said first duct.

4. The machine of claim 3 wherein the effective cross sectional area of said second duct is defined by a restriction in said second duct.

5. The machine of claim 1 wherein said cylinders are mounted in a cylinder drum for rotation about a central bearing shaft, said pressure chamber being disposed within said bearing shaft.

6. The machine of claim 1 wherein said charging of pressurized fluid into, and said discharge of pressurized fluid from, said pressure chamber occur receptively during different time periods.

7. The machine of claim 1 wherein said means for discharging pressurized fluid from said pressure chamber comprises an auxiliary port located in said pressure control device between said pair of spaced control ports, the inlet port of each cylinder being shaped to define a first portion which communicates with said control ports and at least one further portion which communicates with said auxiliary port during said relative motion between said cylinder inlet ports and said pressure control device.

8. The machine of claim 7 wherein said further portion of said inlet port comprises at least tow circumferentially spaced recesses in a wall of said inlet port.

* * * * *